US007102608B2

(12) United States Patent
Bu

(10) Patent No.: US 7,102,608 B2
(45) Date of Patent: Sep. 5, 2006

(54) METHOD AND RELATED APPARATUS FOR DRIVING PIXELS LOCATED IN A ROW OF AN LCD PANEL TOWARD THE SAME AVERAGE VOLTAGE VALUE

(75) Inventor: Lin-Kai Bu, Tainan (TW)

(73) Assignee: Himax Technologies, Inc., Tainan (TW)

( * ) Notice: Subject to any disclaimer, the term of this patent is extended or adjusted under 35 U.S.C. 154(b) by 580 days.

(21) Appl. No.: 10/064,207

(22) Filed: Jun. 21, 2002

(65) Prior Publication Data

US 2003/0234757 A1 Dec. 25, 2003

(51) Int. Cl.
*G09G 3/28* (2006.01)

(52) U.S. Cl. ..... 345/98; 345/99; 345/89; 345/690

(58) Field of Classification Search ..... 345/87–101, 345/204–213, 690–691, 103
See application file for complete search history.

(56) References Cited

U.S. PATENT DOCUMENTS 5,729,246 A * 3/1998 Masuko ..... 345/98
6,426,670 B1 * 7/2002 Tanaka ..... 327/541
6,677,923 B1 * 1/2004 Kajihara et al. ..... 345/89
6,747,624 B1 * 6/2004 Udo et al. ..... 345/89
6,756,962 B1 6/2004 Akimoto et al.

FOREIGN PATENT DOCUMENTS

| | | |
|---|---|---|
| KR | 1998-087415 | 12/1998 |
| KR | 2000-0008960 | 2/2000 |
| TW | 397966 | 7/2000 |

* cited by examiner

*Primary Examiner*—Amr A. Awad
(74) *Attorney, Agent, or Firm*—Winston Hsu

(57) ABSTRACT

A method for driving an LCD monitor is disclosed. The LCD monitor includes a power supply, which has a plurality of outputs for outputting a plurality of voltages. Each of the outputs of the power supply is connected to a specific driving unit. Each driving unit has an output buffer and a switch circuit. In the beginning, the switch circuit is controlled to make voltage at an output port of the driving unit approach voltage at an input port of the driving unit. Then, the switch circuit is controlled to make output ports of the driving units, which approach the same input voltage, electrically connected.

25 Claims, 6 Drawing Sheets

METHOD AND RELATED APPARATUS FOR DRIVING PIXELS LOCATED IN A ROW OF AN LCD PANEL TOWARD THE SAME AVERAGE VOLTAGE VALUE

BACKGROUND OF INVENTION

1. Field of the Invention

The present invention relates to a method and a related apparatus for driving an LCD monitor, and more particularly, to a method and a related apparatus which can drive pixels located in a row of the LCD panel toward a target level so as to display a uniform gray level.

2. Description of the Prior Art

The advantages of the liquid crystal display (LCD) include lighter weight, less electrical consumption, and less radiation contamination. Thus, the LCD has been widely applied to several portable information products such as notebooks, and PDAs. The LCD gradually replaces the cathode ray tube (CRT) monitors of the conventional desktop computers. The incident light will produce different polarization or refraction effects when alignment of these liquid crystal molecules is different. The LCD utilizes the characteristics of the liquid crystal molecules to generate red, blue, and green lights with different intensities of gray level to produce gorgeous images.

Please refer to FIG. 1 of a schematic diagram of a conventional thin film transistor (TFT) liquid crystal display (LCD) 10. The LCD 10 comprises an LCD panel 12, a control circuit 14, a first driving circuit 16, a second driving circuit 18, a first power supply 20, and a second power supply 22. The LCD panel 12 is composed of two substrates and an LCD layer interposed between the two substrates. A plurality of data lines 24, a plurality of gate lines 26, which are perpendicular to the data lines 24, and a plurality of thin film transistors 28 are disposed on one of the two substrates. A common electrode is disposed on the other substrate for providing a constant voltage Vcom via the first power supply 20. For easier description, only one thin film transistor 28 is illustrated in FIG. 1. However, a plurality of thin film transistors 28 are respectively disposed on intersections of the data lines 24 and the gate lines 26 in fact. Thus, the thin film transistors 28 are arranged on the LCD panel 12 in a matrix format. In another words, each of the data lines 24 corresponds to one column of the TFT LCD 10, each of the gate lines 26 corresponds to one row of the TFT LCD 10, and each of the thin film transistors 28 corresponds to one pixel. In addition, the two substrates of the LCD panel 12 can be regarded as an equivalent capacitor 30 according to their electrical performance.

The driving method of the conventional TFT LCD 10 is described as follows. The control circuit 14 is used for controlling driving process of the TFT LCD 10. When the control circuit 14 receives horizontal synchronization 32 and vertical synchronization 34, the control circuit 14 inputs corresponding control signals to the first driving circuit 16 and the second driving circuit 18 respectively. Then, the first driving circuit 16 and the second driving circuit 18 generate input signals for each data line 24, for instance DL3, and each gate line 26, for instance GL3, according to the control signals so as to control conductance of the thin film transistors 28 and voltage differences between two ends of the equivalent capacitors 30 and to rearrange the alignment of the liquid crystal molecules and the corresponding light transmittance in advance. For example, the second driving circuit 18 inputs a pulse to the gate lines 26 so as to make the thin film transistors 28 conduct. Thus, the signals from the first driving circuit 16 to the data lines 24 can be input to the equivalent capacitors 30 via the thin film transistors 28 so as to control the gray levels of the corresponding pixels. In addition, different signals input to the data lines 24 from the first driving circuit 16 are generated by the second power supply 22. The second power supply 22 is controlled according to the control circuit 14 and the display data 36 for providing adequate voltages. The second power supply 22 comprises a plurality of voltage dividing circuits (not shown) to produce different voltages V0 to Vn for driving the thin film transistors 28. Different voltages correspond to different gray levels.

Please refer to FIG. 1 and FIG. 2. FIG. 2 is a schematic diagram of the driving method of the LCD 10 shown in FIG. 1. The second power supply 22 further comprises a voltage selection module 56 and an operational amplifier circuit 37 for driving the corresponding thin film transistors 28 respectively according to the different voltages V0 to Vn generated by the second power supply 22. The operational amplifier circuit 37 comprises a plurality of operational amplifiers 44, 45, 46, 47, 48 and 49. Each of the operational amplifiers 44, 45, 46, 47, 48 and 49 is used to form an output buffer that has a unity gain. In addition, each operational amplifier 44, 45, 46, 47, 48, 49 in the operational amplifier circuit 37 is electrically connected to a corresponding multiplexer (MUX3 to MUX8 shown in FIG. 2) positioned within the voltage selection module 56. It is noteworthy that only six operational amplifiers and related multiplexers are shown in FIG. 2 for simplicity. According to the control signals D3 to D8 outputted from the control circuit 14, the corresponding multiplexers will select one specific voltage level from the different voltages (V0 to Vn) generated by the second power supply 22. The second power supply 22 further comprises a voltage divider for outputting the different voltages V0, V1, . . . , and Vn. It is noteworthy that each voltage level is individually transmitted via a power transmission line such as a metal wire 66 shown in FIG. 2. When the control circuit 14 receives the horizontal synchronization 32 and the vertical synchronization 34, corresponding signals are then generated and are inputted to the first driving circuit 16, the second driving circuit 18, and the second power supply 22. For example, when the second driving circuit 18 generates a pulse to make all thin film transistors located in one row conducted, that means thin film transistors 38, 39, 40, 41, 42 and 43 are conducted. The first driving circuit 16 determines that DL3, DL4, DL5, DL6, DL7, and DL8 in the data lines 24 should be driven under the voltage V1 according to the display data 36 so as to drive the thin film transistor 38, 39, 40, 41, 42 and 43 toward the target voltage V1 via the operational amplifier circuit 37. Therefore, the multiplexers MUX3, MUX4, MUX5, MUX6, MUX7, and MUX8 related to the operational amplifiers 44, 45, 46, 47, 48, and 49 are controlled to select the required voltage level V1. The operational amplifiers 44, 45, 46, 47, 48, and 49 take the voltage level V1 as an input voltage to drive the thin film transistor 38, 39, 40, 41, 42, and 43 later. However, the operational amplifiers 44, 45, 46, 47, 48 and 49 have different offsets affecting the actual output voltages so that the voltage differences of the capacitors 50, 51, 52, 53, 54, and 55 are different. According to the display data 36, the pixels corresponding to DL3, DL4, DL5, DL6, DL7, and DL8 in the data lines 25 should display the same gray level. However, the gray levels in the display screen are not uniform because different offsets of the output voltages are made by the operational amplifiers 44, 45, 46, 47, 48 and 49, which therefore deteriorates the display quality.

SUMMARY OF INVENTION

It is therefore a primary objective of the claimed invention to provide a method for driving an LCD monitor which can make pixels located in the same row of the LCD panel have the same target level so as to display a uniform gray level.

In a first preferred embodiment, the claimed invention provides a method of driving a liquid crystal display (LCD) monitor. The LCD monitor comprises an LCD panel for displaying a plurality of pixels arranged in a matrix format, and a power supply comprising a plurality of power transmission lines for outputting a plurality of voltages. The power transmission lines of the power supply are electrically connected to a plurality of driving units. Each driving unit comprises an output buffer and a switch. A first end of the switch is connected to either an output terminal of the output buffer or an input terminal of the output buffer. A second end of the switch is connected to an output terminal of the driving unit. The method comprises the first end of the switch to the output terminal of the output buffer for driving an output voltage of the driving unit toward a voltage transmitted via the power transmission line of the power supply, and connecting the first end of the switch to the input terminal of the output buffer for driving the output voltage of the driving unit toward an average voltage generated from averaging voltages at output terminals of the driving units that are driven through the same voltage outputted from the same power transmission line.

In a second preferred embodiment, the claimed invention provides a method of driving a liquid crystal display monitor according to a line inversion method. The LCD monitor comprises an LCD panel for displaying a plurality of pixels arranged in a matrix format, and a power supply comprising a plurality of output terminals for outputting a plurality of voltages. Each output terminal of the power supply is selectively and electrically coupled to a driving unit. The driving unit comprises an output buffer, a first switch electrically connected to an output terminal of the output buffer and an output terminal of the driving unit, and a second switch connected to an output terminal of two adjacent driving units. The output terminal of the output buffer is electrically connected to the output terminal of the driving unit when the first switch is turned on, and the output terminal of one driving unit is electrically connected to the output terminal of another driving unit when the second switch is turned on. The method comprises turning on the first switch for driving an output voltage of the driving unit toward a voltage of the output terminal of the power supply that is connected to the driving unit, and turning on the second switch for driving the output voltage of the driving units toward an average voltage generated from averaging voltages at output terminals of the driving units when the driving units are connected to output terminals of the power supply that provide the same voltage.

In the third embodiment, the claimed invention provides a method of driving a liquid crystal display monitor according to a column inversion method, a dot inversion method, and a two dot line inversion. The third embodiment is based on the second preferred embodiment, and the principal difference is that the second switch is connected to output terminals of two driving units with at least one another driving unit positioned between the two driving units. Therefore, the two driving units connected by the second switch are prepared to drive corresponding pixels with voltages having the same polarity and drive the pixels to the same gray level.

It is an advantage of the claimed invention that the pixels located in a row have the same target voltage so as to display data in a uniform gray level.

These and other objectives of the claimed invention will no doubt become obvious to those of ordinary skill in the art after reading the following detailed description of the preferred embodiment which is illustrated in the various figures and drawings.

DETAILED DESCRIPTION

Figure 1:
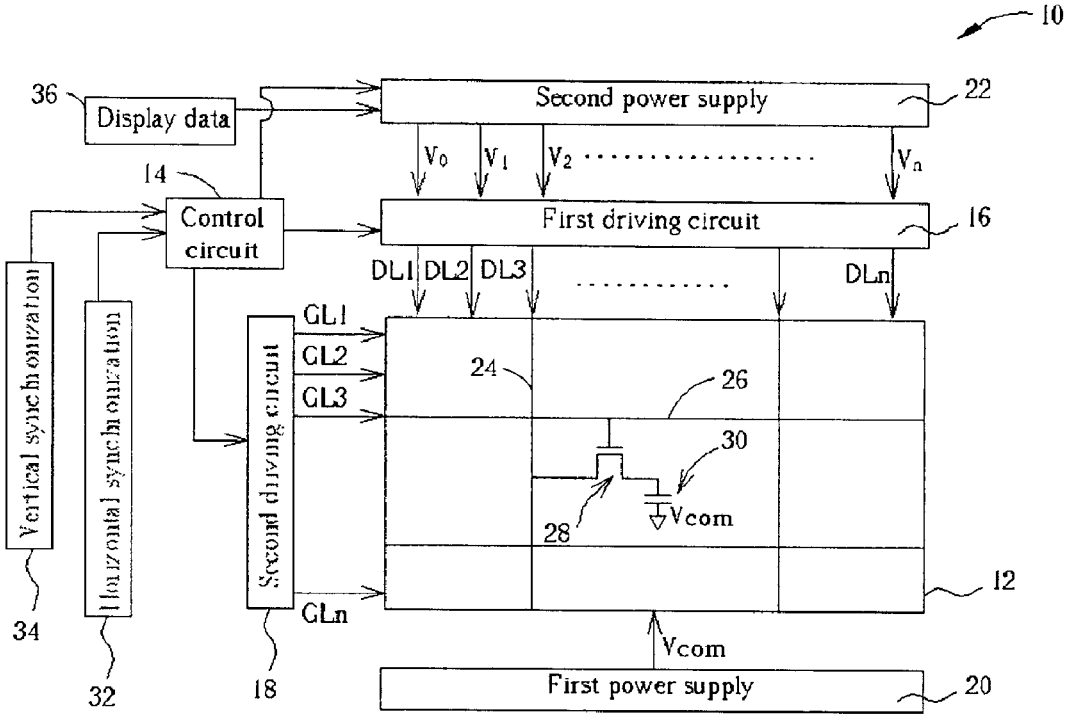
Fig. 1 Prior art
FIG. 1 is a schematic diagram of a conventional thin film transistor liquid crystal display monitor.
Figure 2:
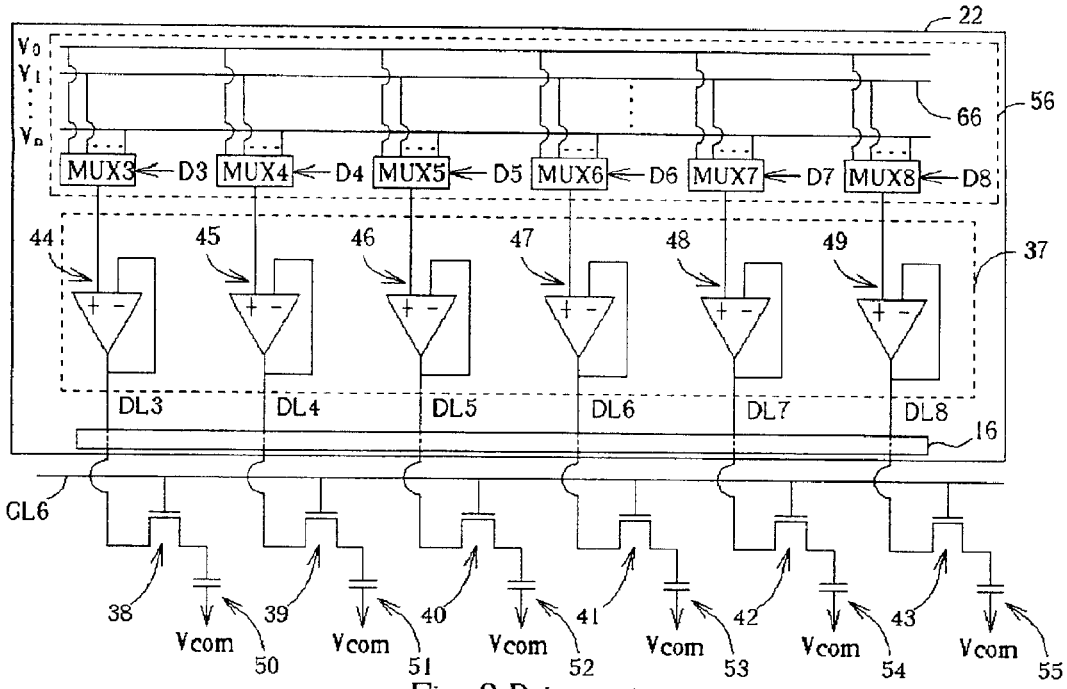
Fig. 2 Prior art
FIG. 2 is a schematic diagram of the second power supply shown in FIG. 1.
Figure 3:
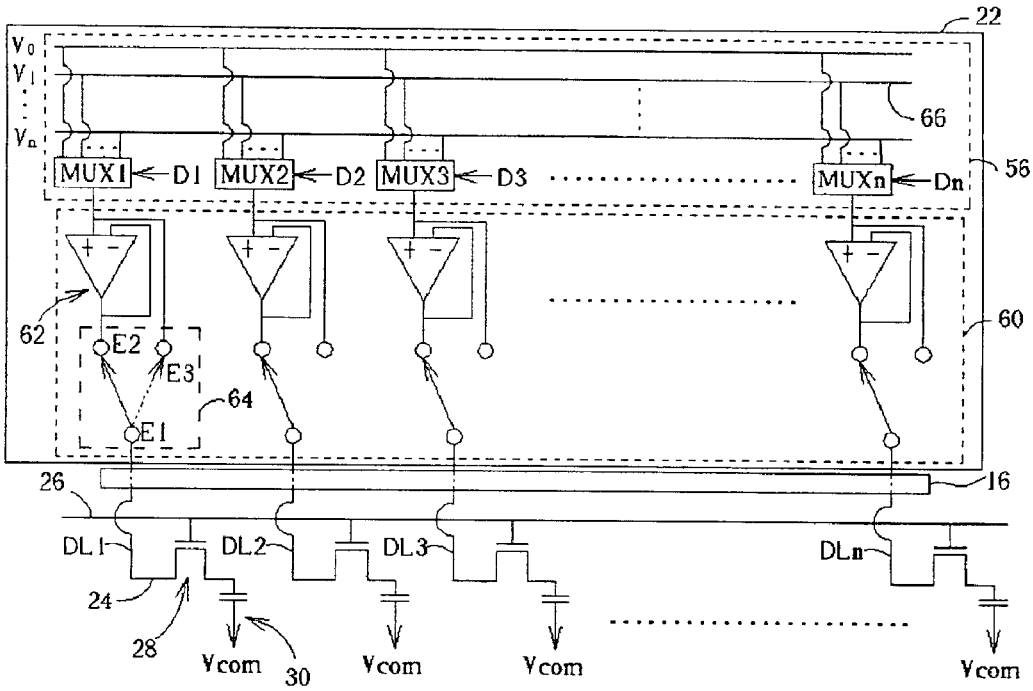
FIG. 3 is a schematic diagram of a first operational amplifier circuit according to the present invention.

Please refer to FIG. 1, FIG. 2, and FIG. 3. FIG. 3 is a schematic diagram of a first operational amplifier circuit 60 according to the present invention. The operational amplifier circuit 60 in the present invention is used to replace the operational amplifier circuit 37 located in the second power supply 22 shown in FIG. 2. Please note that the detailed operation of the voltage selection module 56 has been described before in the prior art section, and the lengthy description is not repeated again for simplicity. The operational amplifier circuit 60 comprises a plurality of operational amplifiers 62 or operational transconductance amplifiers (OTA) to form output buffers with a unity gain and a plurality of switches 64 for controlling current routes. When the second driving circuit 18 inputs a pulse to the gate lines 26 according to the horizontal synchronization 32, all thin film transistors 28 in the same gate line 26 conduct. Thus, the first driving circuit 16 must input the same voltage to DL1, DL2, DL3, . . . DLn in the data line 24 according to the display data 36 so as to display a corresponding gray level. At this time, the multiplexer related to the operational amplifier 62 is controlled to select a required voltage such as V1, and the switch 64 is switched to conduct two ends E1 and E2 so that the voltage V1 can drive the capacitor 30 through the operational amplifier 62. However, each operational amplifier 62 has a specific offset because of a semiconductor process mismatch, that is, each corresponding output voltage varies even the input voltage is the same for each operational amplifier 62. Thus, DL1, DL2, DL3, . . . DLn in the data line 24 have different offsets due to above-mentioned effect of the operational amplifiers 62. Therefore, different voltage levels are stored in each capacitors 30 corresponding to DL1, DL2, DL3, . . . DLn of the data lines 24. Then, the switch 64 is switched to conduct the ends E1 and E3 to change current routes. Therefore, the voltage V1 transmitted by the metal line 66 can not drive the capacitors 30 via the operational amplifier 62 owing to the status change of the switch 64. However, each capacitor 30 is connected to the same metal line 66 due to conducting the ends E1 and E3. Thus, all capacitors 30 are balanced quickly via the metal line 66 so as to have the same voltage level with an averaged offset.

For example, the switch 64 is switched to connect the ends E1 and E2 at first. If the voltage V1 is 5V, the voltages of DL1, DL2, DL3, . . . DLn in the data line 24 are driven toward 5V via the output buffers formed by the operational amplifiers 62. However, the voltages of DL1, DL2, DL3, . . . DLn of the data line 24 vary differently because the offset related to each operational amplifiers 62 is different. For example, the voltages at DL1, DL2, DL3, . . . DLn of the data line 24 are 4.8V, 5.1V, 4.7V, . . . 4.9V respectively. At this time, the switch 64 is switched to connect the ends E1 and E3. Since DL1, DL2, DL3, . . . DLn of the data line 24 are electrically connected to the same metal line 66 via the ends E1 and E3, therefore, the voltages of DL1, DL2, DL3, . . . DLn of the data line 24 will generate an average voltage rapidly. In other words, each voltage of DL1, DL2, DL3, . . . DLn of the data line 24, which are originally 4.8V, 5.1V, 4.7V, . . . 4.9V respectively, come to an average voltage via the metal line 66. It is noteworthy that original different offsets are averaged to generate an identical offset for each data line 24 mentioned above, and the input voltage is then affected by the same averaged offset to generate the average voltage at each data line 24. In addition, the pixels positioned in the same row will have the same gray level when the pixels are driven by the same voltage generated by the second power supply 22.

Figure 4:
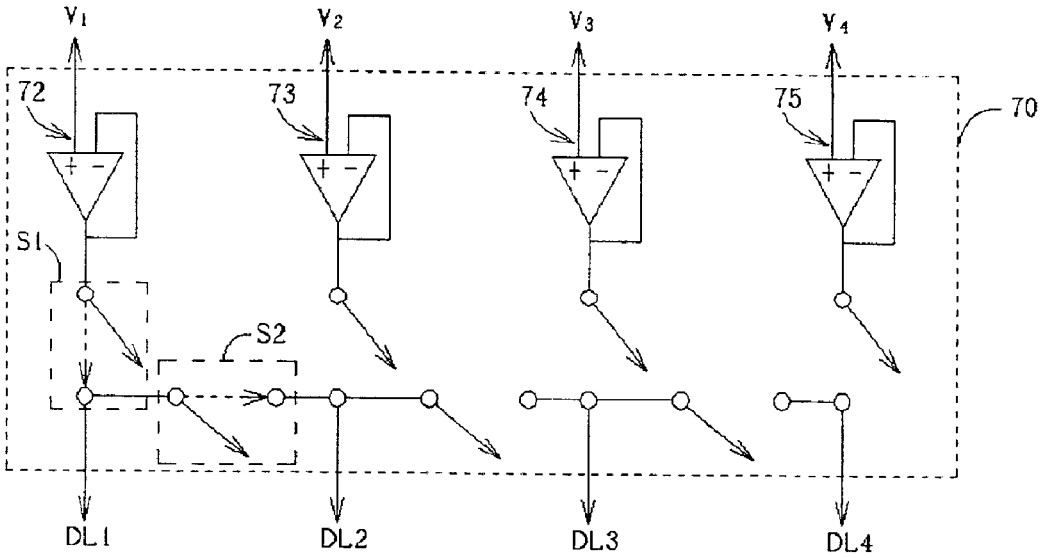
FIG. 4 is a schematic diagram of a second operational amplifier circuit according to the present invention.

Please refer to FIG. 4, which is a schematic diagram of a second operational amplifier circuit 70 according to the present invention. The second operational amplifier circuit 70 has a plurality of operational amplifiers 72, 73, 74, and 75 to function as output buffers, and a plurality of switchs S1, S2 related to the operational amplifiers 72, 73, 74, and 75. Please note that only four operational amplifiers are drawn in FIG. 4 for simplicity, and the operational amplifiers 72, 73, 74, and 75 and switches S1, and S2 are used for driving corresponding pixels through data lines DL1, DL2, DL3, and DL4. The operation of the second operational amplifier circuit 70 is described as follows. In the beginning, each switch S1 is first turned on to make the operational amplifiers 72, 73, 74, and 75 electrically connected to corresponding data lines DL1, DL2, DL3, and DL4. As mentioned before, each operational amplifier 72, 73, 74, and 75 has a unique offset respectively affecting the output voltage to deviate from the input voltage. In other words, if the pixels with regard to the operational amplifiers 72, and 73 are prepared to be driven by the same input voltage level, that is, V1 is equal to V2, the voltage levels of the data lines DL1, and DL2 are different owing to the respective offsets corresponding to the operational amplifiers 72, and 73. Then, all the switches S1 related to the operational amplifiers 72, 73, 74, and 75 are turned off simultaneously. Next, if the operational amplifiers 72, and 73 prepare to drive corresponding pixels toward the same gray level through data lines DL1, and DL2, the switch S2 related to the operational amplifiers 72, and 73 is then turned on. Therefore, the voltage levels of the data lines DL1, and DL2 will quickly approach an average voltage from these two voltage levels. That is, the original offsets are averaged to generate the average voltage for the data lines DL1, and DL2. Similarly, if the operational amplifiers 73, and 74 prepare to drive corresponding pixels toward the same gray level through data lines DL2, and DL3, the switch S2 related to the operational amplifiers 73, and 74 is then turned on as well. Therefore, any adjacent pixels driven by the same input voltage will finally have the same gray level with the help of switch S2. To sum up, voltage at each data line DL1, DL2, DL3, or DL4 is first driven by a corresponding operational amplifier 72, 73, 74, or 75 after the switch Si related to each operational amplifier 72, 73, 74, or 75 is turned on. Then, each switch S1 is turned off. In addition, the switch S2 is turned on when related adjacent pixels related to the switch S2 are prepared to have the same gray level. Finally, the voltage deviation between the adjacent data lines is eliminated by averaging the offsets generated by the corresponding operational amplifiers through the switch S2. In the preferred embodiment, the second operational amplifier circuit 70 is applied on a LCD panel driven according to a line inversion method. Because the pixels positioned in the same row will have the same polarity according to the line inversion method, the switch S2 is capable of averaging voltages with the same polarity at adjacent data lines such as data lines DL1, and DL2. In addition, the different offsets are not averaged through the voltage selection module 56 shown in FIG. 3 but are averaged through the related switch S2. Therefore, any voltage divider circuit that can provide the operational amplifier circuit 70 with different voltage levels is suitable for the second power supply 22 in the preferred embodiment.

Figure 5:
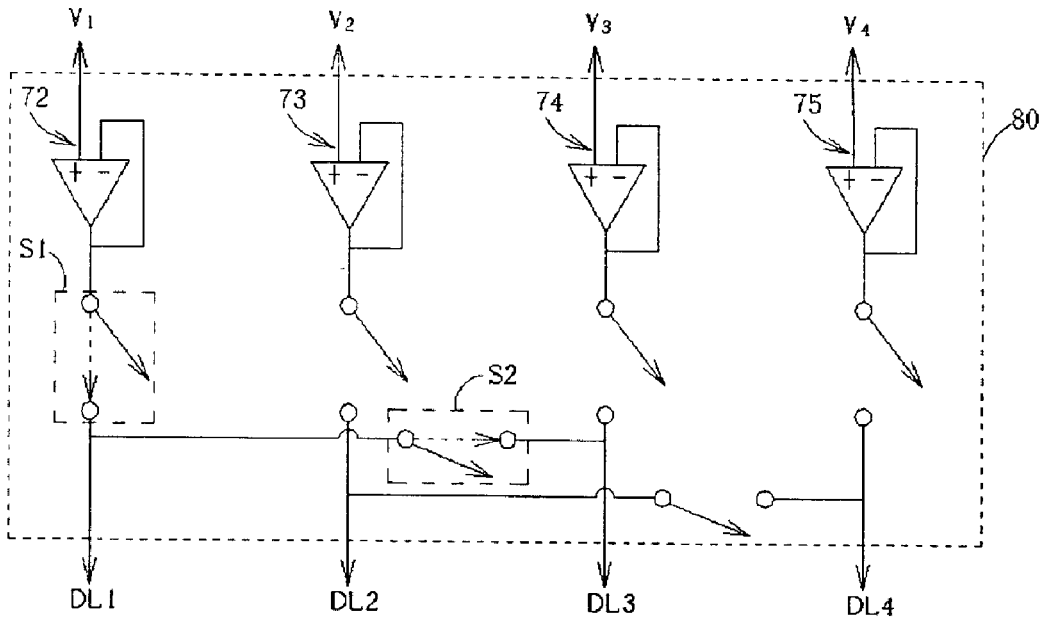
FIG. 5 is a schematic diagram of a third operational amplifier circuit according to the present invention.

Please refer to FIG. 5, which is a schematic diagram of a third operational amplifier circuit 80 according to the present invention. The third operational amplifier circuit 80 is similar to the second operational amplifier circuit 70. Only the arrangement of the switches S1, and S2 is different. As shown in FIG. 5, there is a switch S2 electrically connected to the operational amplifiers 72, 74, and another switch S2 is electrically connected to the operational amplifiers 73, 75. That is, the adjacent data lines such as DL1, and DL2 are not connected through the switch S2. When pixels are driven by a dot inversion method, a two dot line inversion method, or a column inversion method, adjacent pixels in the same row are driven by voltages with opposite polarities. That is, pixels connected to lines DL1, DL2, DL3, DL4 respectively have polarities such as "+""−""+""−" or "−""+""−""+". Therefore, the third operational amplifier circuit 80 uses switches S2 connected to adjacent operational amplifiers that have the same polarity for averaging above-mentioned offsets when corresponding pixels with the same polarity are driven to the identical gray level. For example, if the pixels connected to the data lines DL1, and DL3 are going to have the same gray level, the switches S1 corresponding to operational amplifiers 72, and 74 are first turned on in the beginning. Because the offsets related to the operational amplifiers 72, and 74 are different, the voltages at the data lines DL1, and DL3 are different as well. Then, the switch S2 related to the lines DL1, and DL3 is turned on. Therefore, the voltage deviation between the lines DL1, and DL3 is eliminated by averaging the offsets generated by the corresponding operational amplifiers 72, and 74. It is noteworthy that the offsets generated from the operational amplifiers 72, and 74 are averaged to generate an average voltage at both lines DL1, and DL3. In other words, the lines DL1, and DL3 still have an averaged offset according to the present invention. But, the voltages at data lines DL1, and DL3 are equal after all. In addition, if two adjacent pixels are not going to have the same gray level, the switch S2 related to the corresponding pixels is kept off without affecting the gray levels of the adjacent pixels. In the preferred embodiment, the switch S2 is connected to two data lines driven according to the same polarity, and these two data lines is spaced by another data line driven according to an opposite polarity. That is, the third operational amplifier circuit 80 is applied on an LCD panel driven by a column inversion method, a dot inversion method, or a two dot line inversion. In addition, the different offsets are not averaged through the voltage selection module 56 shown in FIG. 3 but are averaged through the related switch S2. Therefore, any voltage divider circuit that can provide the operational amplifier circuit 70 with different voltage levels is suitable for the second power supply 22 in the preferred embodiment.

Figure 6:
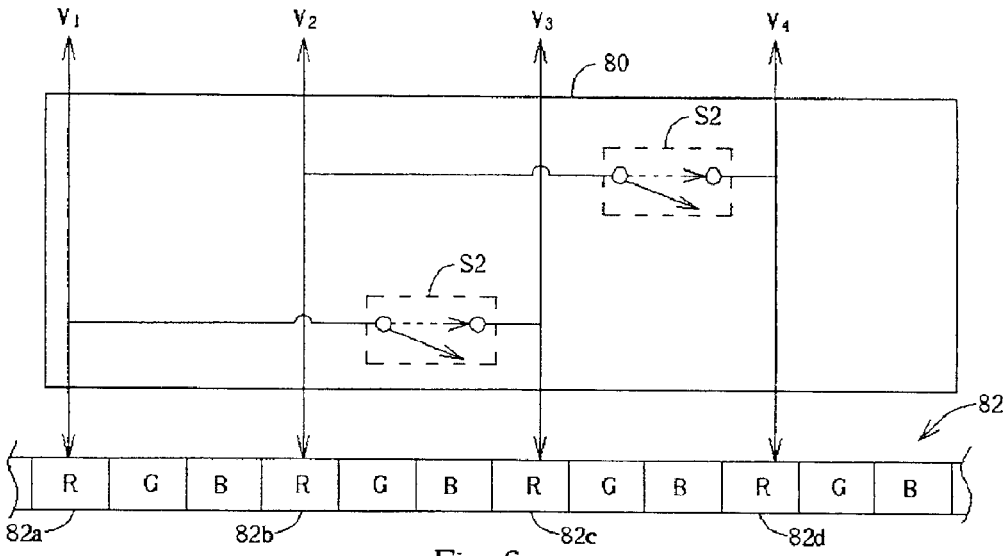
FIG. 6 is a simplified diagram of a connection between pixels and the third operational amplifier circuit shown in FIG. 5.

Please refer to FIG. 6, which is a simplified diagram of a connection between pixels 82 and the third operational amplifier circuit 80 shown in FIG. 5. A specific color is generated by mixing three monochromatic lights such as a red light, a green light, and a blue light respectively having different intensities. Therefore, pixels 82 located at the same row are individually responsible for providing a gray level with regard to the red light, the green light, or the blue light. As shown in FIG. 6, there are pixels 82 used for representing a color sequence "RGBRGBRGBRGB". When the pixels 82 are driven according to a dot inversion method, a two dot line inversion method, or a column inversion method, adjacent pixels 82 will have opposite polarities. For example, the pixels 82 are driven according to a polarity sequence "+−+−+−+−+−+−". Concerning the red light, the pixels 82*a* and 82*c* have the same polarity "+", and the pixels 82*b* and 82*d* have the same polarity "−". For the pixels 82*a*, 82*b*, 82*c*, and 82*d* with regard to the red light, one switch S2 is connected between the pixels 82*a* and 82*c* driven by the same polarity "+". In addition, another switch S2 is connected between the pixels 82*b* and 82*d*. Therefore, when the third operational amplifier circuit 80 is used for driving pixels with regard to one specific monochromatic light, a switch S2 is responsible for equaling voltages inputted into two adjacent pixels driven by the same polarity and driven to the same gray level. It is noteworthy that the above-mentioned driving method is also applied on driving pixels with regard to green light and blue light, and the repeated description is skipped for simplicity.

The voltage selection module 56 shown in FIG. 3 is used for providing the operational amplifier circuit 60 with appropriate voltage levels. In addition, the metal lines 66 within the voltage selection module 56 not only transmit electric power but also average voltage levels at different data lines 24. That is, the pixels located at different positions in the same row will have the same gray level when driven by the same voltage provided by the voltage selection module 56. The metal line 66 performs a global voltage average operation. The operational amplifier circuits 70, and 80 shown in FIG. 4 and FIG. 5 use switches S2 to perform the local voltage average operation. That is, the switch S2 is turned on only when two adjacent pixels related to the switch S2 are prepared to be driven by an identical voltage level. Users are only sensitive to gray level difference between adjacent pixels, but are not sensitive to the gray level of each pixel. Therefore, the objective of the operational amplifier circuits 70, and 80 is to eliminate the gray level difference between adjacent pixels when the adjacent pixels are driven by the same voltage level. That is, switches S2 of the operational amplifier circuits 70, and 80 take place of the metal lines 66 located in the voltage selection module 56 for eliminating voltage deviations between two adjacent pixels only to achieve a uniform gray level.

As mentioned above, the second operational amplifier circuit 70 is applied on an LCD monitor driven by a line inversion method, and the third operational amplifier circuit 80 is applied on an LCD monitor driven by a column inversion method, a dot inversion method, or a two dot line inversion. Therefore, the operational amplifier circuit according to the present invention can be applied on an LCD monitor, which is driven according to a predetermined method, to solve the offset deviation problem. In addition, the TFT LCD according to the present invention further comprises a XOR logic circuit or a comparator to determine whether the switche S2 is turned on or not. That is, the XOR logic circuit is used for comparing digital input driving data related two pixels to check whether the pixels are going to have the same gray level, and the comparator is used for comparing analog input driving data related to two pixels to check whether the pixels are going to have the same gray level. When the XOR logic circuit or the comparator acknowledges that two pixels are prepared to be driven toward the same gray level, the switch S2 related to the pixels will be turned on to eliminate the offset deviation. In other words, the TFT LCD has a detecting circuit such as a XOR logic circuit for digital driving data or a comparator for analog driving data to compare driving data with regard to two pixels. When these two pixels are going to have the same gray level, the switch S2 related to these two pixels is turned on according to a comparison result generated from the XOR logic circuit or the comparator. Furthermore, the present invention is capable of using operational transconductance amplifiersinstead of the operational amplifiers to drive the pixels.

In contrast to the prior art, the driving method according to the present invention uses a switch to connect the output terminals of the output buffers. Therefore, the power supply generates a target level to drive the pixels located in a row of the LCD panel toward the same target level. There are different offsets between the output levels of the driving units for driving the pixels and the target level. When the output terminals of the output buffers are connected together via the switches, the original different output levels of driving units of each pixels are changed towards an average voltage generated from averaging voltages at output terminals of the driving units of the pixel. Although the average voltage may be not exactly equal to the target level, the pixels, which are located in the same row and are predetermined to be driven toward the same target level, are driven to the same level by using the method of the present invention. Thus, the uniformity problem in the prior art caused by level offsets can be solved.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A method of driving a liquid crystal display (LCD) monitor, the LCD monitor comprising:

an LCD panel for displaying a plurality of pixels arranged in a matrix format; and a power supply comprising a plurality of power transmission lines for carrying a plurality of voltages, the power transmission lines of the power supply being electrically coupled to a plurality of driving units, each driving unit comprising an output buffer and a switch, a first end of the switch being selectively connected to either an output terminal of the output buffer or an input terminal of the output buffer, a second end of the switch being connected to an output terminal of the driving unit;

said method comprising:

disconnecting the first end of the switch from the input terminal of the output buffer and connecting the first cad of the switch to the output terminal of the output buffer for driving an output voltage of the driving unit toward a voltage transmitted via the power transmission line of the power supply; and disconnecting the first end of the switch from the output terminal of the output buffer and connecting the first end of the switch to the input terminal of the output buffer for driving the output voltage of the driving unit toward an average voltage generated from averaging voltages at output terminals of the driving units that are connected to the game power transmission line.

2. The method of claim 1 wherein the output buffer further comprises an operational amplifier.

3. The method of claim 1 wherein the output buffer further comprises an operational transconductance amplifier.

4. The method of claim 1 wherein the first end of the switch is first connected to the output terminal of the output buffer and then connected to the input terminal of the output buffer.

5. The method of claim 4 wherein the driving units that are connected to the same voltage transmitted via the corresponding power transmission line of the power supply simultaneously drive the pixels located in a row of the LCD panel toward a target level after the first end of the switch is connected to the input terminal of the output buffer.

6. The method of claim 1 wherein the voltage transmitted via the power transmission line of the power supply is generated by a voltage divider.

7. The method of claim 1 wherein the power supply further comprises a plurality of multiplexers each electrically connected to one of the driving units and the power transmission lines, and the multiplexer is used for selecting a current route connecting the driving unit and one of the power transmission lines.

8. A method of driving a liquid crystal display (LCD) monitor, the LCD monitor comprising:

an LCD panel for displaying a plurality of pixels arranged in a matrix format;

a power supply comprising a plurality of output terminals for outputting a plurality of voltages, each output terminal of the power supply being selectively, electrically coupled to a driving unit, the driving unit comprising an output buffer, a first switch electrically connected to an output terminal of the output buffer and an output terminal of the driving unit, and a second switch connected to an output terminal of one driving unit and an output terminal of another driving unit, the output terminal of the output buffer being electrically connected to the output terminal of the driving unit when the first switch is turned on, the output terminal of one driving unit being electrically connected to the output terminal of another driving unit when the second switch is turned on;

said method comprising:

turning on the first switch for driving an output voltage of the driving unit toward a voltage of the output terminal of the power supply that is connected to the driving unit; and turning on the second switch for driving the output voltage of the driving units toward an average voltage generated from averaging voltages at output terminals of the driving units when the driving units are connected to output terminals of the power supply that provide the same voltage.

9. The method of claim 8 wherein the output buffer further comprises an operational amplifier.

10. The method of claim 8 wherein the output buffer further comprises an operational transconductance amplifier.

11. The method of claim 8 wherein the voltage outputted from the power supply is generated by a voltage divider.

12. The method of claim 8, wherein the second switch is turned off in said step of turning on the first switch; and the first switch is turned off in said step of turning on the second switch.

13. The method of claim 12, further comprising detecting whether two driving units receive the same voltage from the power supply before said step of turning on the second switch, and if two driving units receive the same voltage proceeding with said step of turning on the second switch.

14. The method of claim 8 wherein the second switch is connected to output terminals of two driving units, and the two driving units are prepared to drive corresponding pixels with voltages having the same polarity.

15. The method of claim 14 wherein the second switch is connected to output terminals of two adjacent driving units.

16. The method of claim 14 wherein the second switch is connected to output terminals of two driving units with at least one another driving unit positioned between the two driving units.

17. The method of claim 8 wherein the LCD monitor further comprises a detecting circuit for comparing two input driving data with regard to the driving units that are connected to the second switch to determine whether the corresponding second switch is turned on or not.

18. The method of claim 17 wherein the input driving data comprise a plurality of binary bits, and the detecting circuit is a XOR logic circuit for comparing binary bits.

19. The method of claim 17 wherein the input driving data comprise a plurality of voltage levels, and the detecting circuit is a comparator for comparing voltage levels.

20. A driving device for driving a liquid crystal display (LCD) monitor, the LCD monitor comprising an LCD panel for displaying a plurality of pixels arranged in a matrix format, said driving device comprising:

a power supply comprising a plurality of power transmission lines for carrying a plurality of voltages;

a plurality of driving units electrically coupled to the power transmission lines of said power supply, each driving unit comprising an output buffer and a switch, a first end of said switch being selectively connected to either an output terminal of said output buffer or an input terminal of said output buffer, a second end of said switch being connected to an output terminal of said driving unit;

wherein the first end of said switch is first connected to the output terminal of said output buffer for driving an output voltage of the driving unit toward a voltage transmitted via the power transmission line of said power supply, and the first end of said switch is then connected to the input terminal of said output buffer for driving the output voltage of said driving unit toward an average voltage generated from averaging voltages at output terminals of said driving units that are connected to the same power transmission line.

21. A driving device for driving a liquid crystal display (LCD) monitor, the LCD monitor comprising an LCD panel for displaying a plurality of pixels arranged in a matrix format, said driving device comprising:

a power supply comprising a plurality of output terminals for outputting a plurality of voltages;

a plurality of driving units electrically connected to the output terminals of said power supply, said driving unit comprising:

an output buffer;

a first switch connected between an output terminal of said output buffer and an output terminal of said driving unit, the output terminal of said output buffer being electrically connected to the output terminal of said driving unit when said first switch is turned on; and a second switch connected between the output terminal of said driving unit and an output terminal of another driving unit, the output terminal of said driving unit being electrically connected to the output terminal of another driving unit when said second switch is turned on;

wherein said first switch is first turned on to drive an output voltage of said driving unit toward a voltage of the output terminal of said power supply that is connected to said driving unit, and said second switch is then turned on to drive the output voltage of said driving units toward an average voltage generated from averaging voltages at output terminals of said driving units when said driving units are connected to output terminals of said power supply that provide the same voltage.

22. A driving device for driving a flat panel display including a plurality of pixels arranged in a matrix format, said driving device comprising:

a first driving units receiving a first voltage and being provided to drive the pixels of the flat panel display, said first driving unit comprising:

a first output buffer;

a first switch electrically connected between an output terminal of said first output buffer and an output terminal of said first driving unit;

a second driving units receiving a second voltage and driving the pixels of the flat panel display, said second driving unit comprising:

a second output buffer;

a second switch electrically connected between an output terminal of said second output buffer and an output terminal of said second driving unit;

a third switch electrically connected between the output terminal of said first driving unit and the output terminal of said second driving unit; and a detecting circuit for controlling said third switch according to the first voltage and the second voltage.

23. The driving device of claim 22, said third switch is turned on if the first voltage and the second voltage are substantially the same.

24. A driving device for driving a flat panel display including a plurality of pixels arranged in a matrix format, said driving device comprising:

a first driving units receiving a first voltage and being provided to drive the pixels of the flat panel display, the first voltage is provided according to a first input driving data, said first driving unit comprising:

a first output buffer;

a first switch electrically connected between an output terminal of said first output buffer and an output terminal of said first driving unit;

a second driving units receiving a second voltage and driving the pixels of the flat panel display, the second voltage is provided according to a second input driving data, said second driving unit comprising:

a second output buffer;

a second switch electrically connected between an output terminal of said second output buffer and an output terminal of said second driving unit;

a third switch electrically connected between the output terminal of said first driving unit and the output terminal of said second driving unit; and a detecting circuit for controlling said third switch according to the first input driving data and the second input driving data.

25. The driving device of claim 24, said third switch is turned on if the first input driving data and the second input driving data are the same.

* * * * *